United States Patent [19]

Schmid

[11] Patent Number: 4,898,069

[45] Date of Patent: Feb. 6, 1990

[54] APPARATUS FOR TRANSPORTING CARTRIDGES TO A FIRING WEAPON WITH AN ELEVATION CONTROL SYSTEM

[75] Inventor: Samuel Schmid, Dietlikon, Switzerland

[73] Assignee: Werkzeugmaschinenfabrik Oerlikon-Bührle AG, Zuml/u/ rich, Switzerland

[21] Appl. No.: 167,028

[22] Filed: Mar. 11, 1988

Related U.S. Application Data

[63] Continuation-in-part of Ser. No. 864,773, May 19, 1986, abandoned.

[30] Foreign Application Priority Data

Jun. 4, 1985 [CH] Switzerland ..... 02355/85

[51] Int. Cl.[4] ..... F41D 10/38

[52] U.S. Cl. ..... 89/33.01; 89/33.1

[58] Field of Search ..... 89/33.2, 33.14, 33.02, 89/36.13, 33.1, 33.16, 33.17, 34, 33.25, 33.01

[56] References Cited

U.S. PATENT DOCUMENTS

| | | | |
|---|---|---|---|
| H164 | 11/1986 | Savioli | 89/33.02 |
| 1,519,454 | 12/1924 | Inglis | 89/33.14 |
| 2,379,185 | 6/1945 | Reek | 89/33.16 |
| 2,380,773 | 7/1945 | McMullen | 89/33.14 |
| 2,550,837 | 5/1951 | MacKenzie | 89/33.14 |
| 2,935,914 | 5/1960 | Darsie et al. | 89/33.02 |
| 3,333,507 | 8/1967 | Meiss | 89/34 |
| 3,608,426 | 9/1971 | Jackson | 89/33.14 |
| 3,788,189 | 1/1974 | Sachleben et al. | 89/34 |
| 4,424,735 | 1/1984 | Bacon et al. | 89/34 |
| 4,762,049 | 8/1988 | Hughes | 89/33.14 |

FOREIGN PATENT DOCUMENTS

| | | | |
|---|---|---|---|
| 876888 | 11/1942 | France | 89/33.14 |
| 301283 | 5/1968 | Sweden | 89/36.13 |
| 1337388 | 11/1973 | United Kingdom | 89/33.02 |

OTHER PUBLICATIONS

General Electric Company, Vulcan Air DeFense System, 1/76.

*Primary Examiner*—Harold J. Tudor
*Assistant Examiner*—Stephen Johnson
*Attorney, Agent, or Firm*—Werner W. Kleeman

[57] ABSTRACT

For feeding cartridges from a stationary container to a firing weapon having an elevation adjustability or control, it is necessary to provide means for deflecting cartridges according to the weapon's elevation. It is common practice to use either plate channel arrangements or flexible cartridge feed channels as a deflecting mechanism, both of which however, are afflicted with serious shortcomings. According to this invention, the deflecting mechanism involves a helical cartridge feed channel which is attached to the firing weapon and which comprises an infeed aperture or opening where cartridges are coaxially aligned with respect to the elevation axis and an outfeed aperture or opening where cartridges are in essentially parallel alignment with the weapon barrel axis.

13 Claims, 3 Drawing Sheets

APPARATUS FOR TRANSPORTING CARTRIDGES TO A FIRING WEAPON WITH AN ELEVATION CONTROL SYSTEM

CROSS-REFERENCE TO RELATED APPLICATION

This application is a continuation-in-part application of the commonly assigned, co-pending U.S. application Ser. No. 06/864,773, filed May 19, 1986, and entitled "APPARATUS FOR TRANSPORTING CARTRIDGES TO A FIRING WEAPON WITH AN ELEVATION CONTROL SYSTEM" now abandoned.

BACKGROUND OF THE INVENTION

The present invention relates to a new and improved construction of an apparatus for feeding cartridges from a stationary container to a firing weapon adjustable to a desired elevation about an elevation axis.

In its more particular aspects, the present invention specifically relates to a new and improved construction of an apparatus for feeding cartridges from a stationary container to a firing weapon adjustable to a desired elevation about an elevation axis, and which apparatus contains deflection means for deflecting the cartridges according to the given elevation of the firing weapon and for guiding or infeeding such cartridges into the firing weapon.

It is common practice to construct such deflection mechanisms using plate channel arrangements. Such a plate channel arrangement is described in German patent No. 3,204,499, published Aug. 18, 1983. Individual discs of the plate channel arrangement are supported by bearings in three different locations permitting plate rotation. Furthermore, the discs are interconnected by means of a gearing or transmission mechanism with decreasing reduction or gearing ratios from plate to plate. In addition, these discs are interconnected with the weapon as well as with the stationary channel by means of flexible links.

In lieu of a plate channel, it is also feasible to use a flexible channel. U.S. Pat. No. 3,437,005 describes a flexible feed channel. The ammunition is transported from a stationary container to a rapid-fire weapon, e.g. a Gatling cannon, by means of such a flexible feed channel. This however, exposes the flexible channel to a considerable amount of bending and twisting loads.

All of these known feeding systems are afflicted with severe drawbacks such as those described below:

(a) A plate channel system limits the useable elevation range. The weapon can be pivoted by ±45° with respect to an initial reference or middle position.

Therefore, shooting problems will arise either on the horizon or in zenith during weapon firing.

(b) A plate channel system requires a lot of space inherent with a large mass which needs to be accelerated and decelerated.

(c) Flexible feed channels are exposed to excessive wear. They also exhibit long dimensions and are thus cumbersome.

SUMMARY OF THE INVENTION

Therefore, with the foregoing in mind, it is a primary object of the present invention to provide a new and improved construction of an apparatus for feeding cartridges to an elevatable firing weapon which does not exhibit the aforementioned drawbacks and shortcomings of the prior art constructions.

Another object of the present invention aims at providing a new and improved construction of an apparatus of the previously mentioned type for reliable deflection of cartridges and which apparatus has a minimum number of constructional components.

Still another significant object of the present invention aims at providing a new and improved construction of an apparatus of the character described which is relatively simple in construction and design, highly reliable in operation and easy to handle.

Now in order to implement these and still further objects of the invention, which will become more readily apparent as the description proceeds, the apparatus of the present invention is manifested by the features that, among other things, it comprises a deflecting or deflection device including a substantially rigid or non-flexible helical cartridge feed channel fastened to the weapon. The cartridges are positioned substantially parallel to, for instance, essentially coaxially with respect to the elevation axis of the firing weapon at the infeed aperture or opening of the deflection device and the cartridges are positioned essentially in parallel to the weapon barrel axis of the weapon at the exit or outfeed aperture of the deflection device, whereby the cartridges located within the cartridge feed channel form a helix as seen along their centers of gravity. The centers of gravity of the cartridges are located substantially along such helix.

Preferably, the axis of this helix is to be inclined by 45° with respect to the elevation axis as well as with respect to the weapon barrel axis, thus causing cartridges located within the cartridge feed channel to be deflected or turned by 90°.

In other words, the apparatus of the present invention for feeding cartridges from a stationary container to a firing weapon is manifested by the features that the deflection device or deflection means comprises a substantially rigid or non-flexible helical cartridge feed channel. The substantially rigid or non-flexible helical cartridge feed channel defines an infeed opening and an outfeed opening. The cartridges are arranged at the region of or adjacent to the elevation axis and are preferably substantially coaxially arranged with respect to the elevation axis at the infeed opening of the substantially rigid or non-flexible helical cartridge feed channel. The firing weapon contains a weapon barrel defining a weapon barrel axis. The cartridges are arranged substantially parallel to the weapon barrel axis at the outfeed opening of the substantially helical cartridge feed channel. Each cartridge of the cartridges possesses a center of gravity and the cartridges are located within the substantially helical cartridge feed channel such that the centers of gravity are positioned substantially along a helix.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures of the drawings there have been generally used the same reference characters to denote the same or analogous components and wherein:

FIGS. 1*a*–3*a* respectively illustrate a schematic top view, a side view and a front view of the cartridge feed channel;

FIG. 5 shows a schematic view of the cartridge feeding scheme of the helical cartridge feed channel according to FIGS. 1*a*–3*a* and FIG. 4*a.

DETAILED DESCRIPTION OF THE PREFERRED EMBODIMENTS

Figure 2:
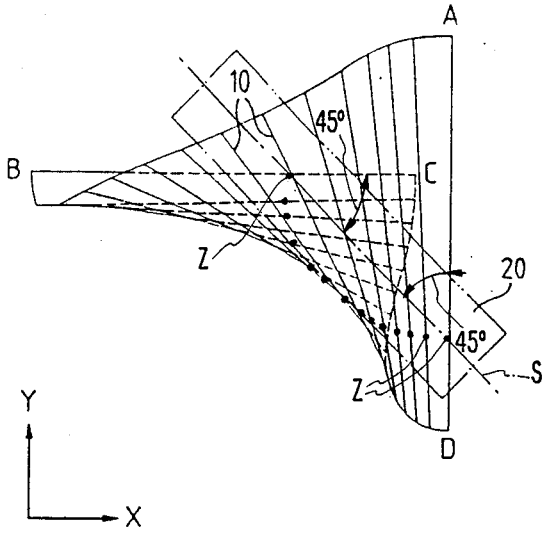
FIGS. 1–3 respectively illustrate a top view, a side view and a front view of the axes of cartridges located within a helical cartridge feed channel.
Figure 1:
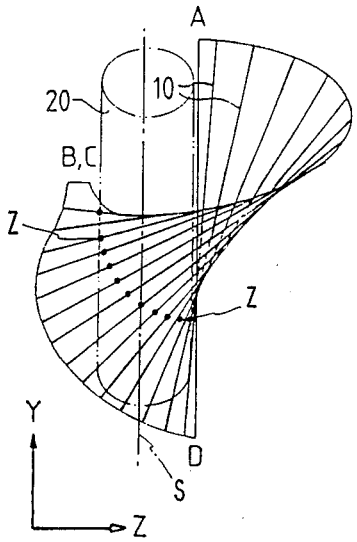
Figure 3:
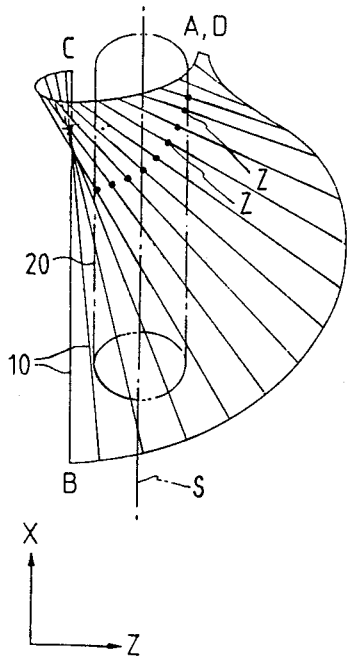
Figure 2A:
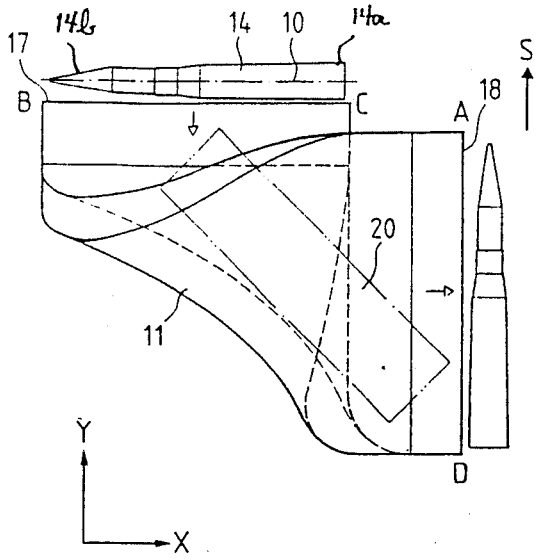
Figure 1A:
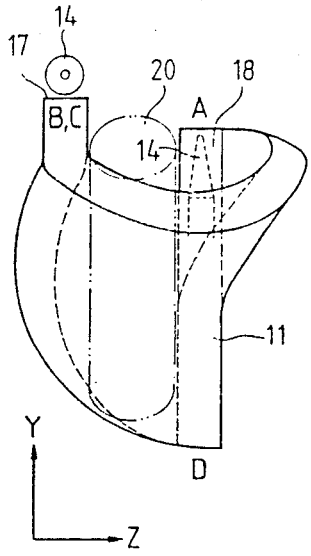

Describing now the drawings, it is to be understood that to simplify the showing thereof, only enough of the structure of the apparatus for transporting cartridges to an elevationally adjustable firing weapon has been illustrated therein as is needed to enable one skilled in the art to readily understand the underlying principles and concepts of the present invention. Turning now specifically to FIGS. 1 to 3 of the drawings, it will be seen that the line B–C represents an axis 10 of a cartridge 14 (FIGS. 1*a*–3*a*) which axis 10 here is shown to substantially coincide with an elevation axis 16 (FIG. 6) of a firing weapon 13. The line A–D represents the axis 10 of a cartridge 14 which lies essentially parallel to a weapon barrel axis 40 of the weapon barrel 42 of the firing weapon 13 as indicated for instance in FIG. 6. Furthermore, between the cartridge axes 10 represented by the lines B–C and A–D, there are shown a number of intermediate axes 10. These cartridge axes 10 all belong to the belted cartridges 14 which are being transported from the position substantially coinciding with the elevation axis 16 of the firing weapon 13 to the position essentially parallel to weapon barrel axis 40.

Figure 5:
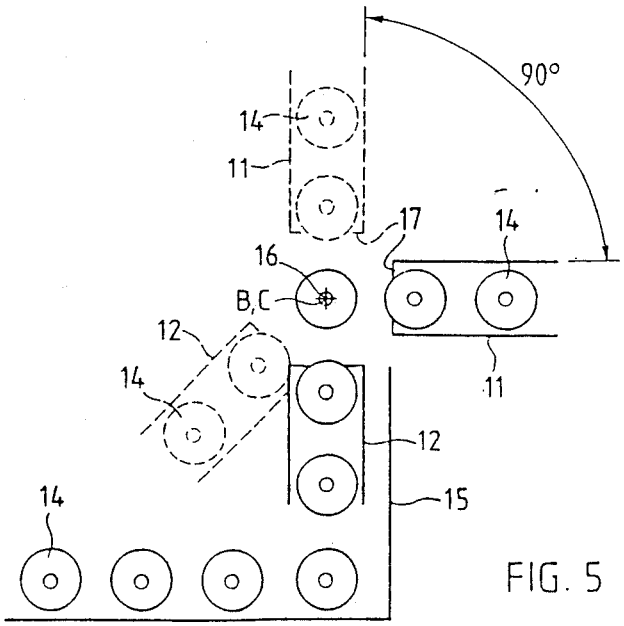

The cartridges 14 reach the elevation axis 16 either directly from a stationary container 15 or a stationary cartridge feed channel 12 which can be positioned either vertically or at an angle of 45° as shown in FIG. 5 by solid lines or dashed lines, respectively. This cartridge feed channel 12 may be stationary since the elevation axis 16 does not change its position when increasing or altering the elevation of the firing weapon 13.

Figure 4:
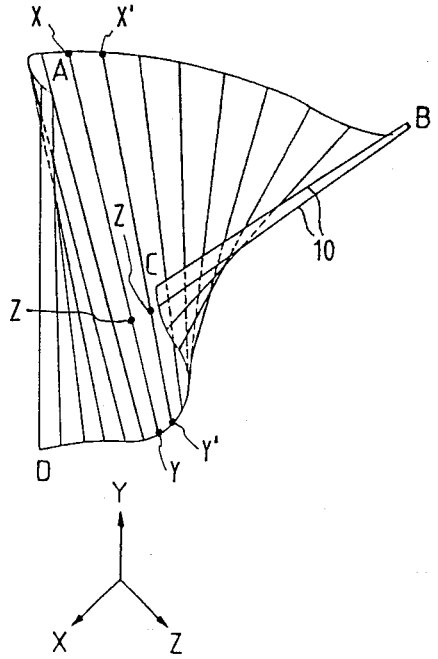
FIG. 4 shows a perspective view of the cartridge axes shown in FIGS. 1–3.
Figure 4A:
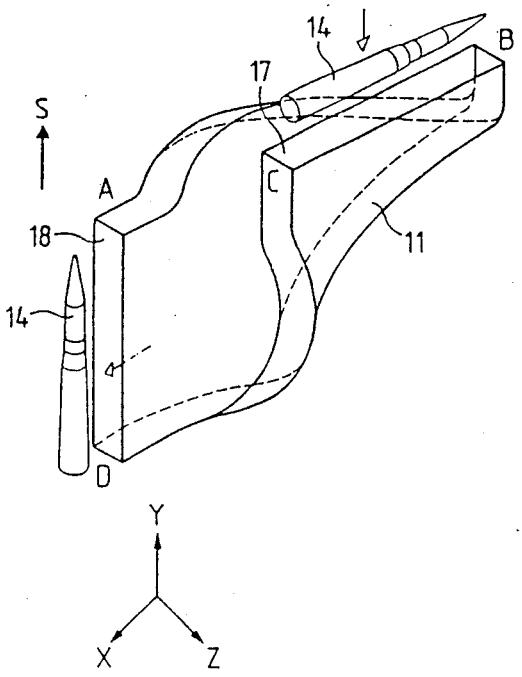
FIG. 4*a* shows a perspective view of the cartridge feed channel shown in FIGS. 1*a*–3*a;*
Figure 3A:
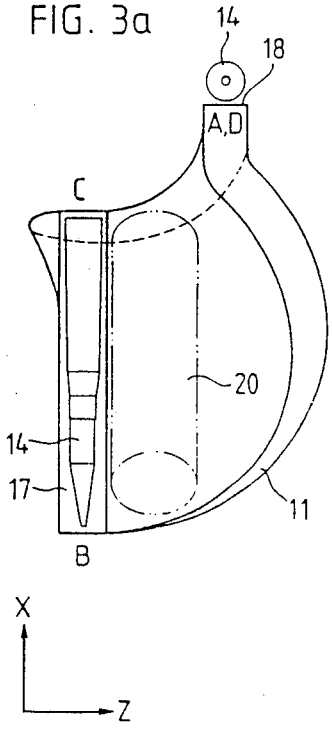

From the elevation axis 16 to the weapon barrel axis 40, the cartridges 14 are transported by means of a pivotable rigid or non-flexible cartridge feed channel 11 which is mounted to the firing weapon 13. This pivotable cartridge feed channel 11 provides approximately 90° deflection of the cartridges 14 as can be seen from FIGS. 1–3 or FIGS. 1*a*–3*a*, respectively, since the cartridge axes 10 represented by the lines B–C and A–D are oriented perpendicularly with respect to each other. The pivotable cartridge feed channel 11 which is fastened to the firing weapon 13 (see also FIGS. 4 and 4*a*) comprises an infeed opening or aperture 17 and an outfeed opening or aperture 18. The cartridge axis 10 represented by the line B–C is located in front of the infeed opening 17 and the cartridge axis 10 represented by the line A–D is located within the outfeed opening 18. Upon adjusting the elevation of the firing weapon 13, the position of the pivotable cartridge feed channel 11 changes, but its infeed opening 17 remains within the region or neighborhood of the elevation axis 16, thus guaranteeing trouble-free guidance of the cartridges 14 from the stationary cartridge feed channel 12 or from the container 15 to the pivotable cartridge feed channel 11 independently of the elevational position of the firing weapon 13.

From the stationary container 15, the cartridges 14 are transported to the elevation axis 16 in such a way that the cartridge axis 10 represented by the line B–C and the elevation axis 16 coincide, which means that the cartridge 14 is positioned coaxially with respect to the elevation axis 16. According to FIG. 5, the pivotable cartridge feed channel 11 together with the firing weapon 13 (FIG. 6) can be elevated by 90° without appreciably jeopardizing the cartridge feeding procedure from the stationary feed channel 12 to the pivotable cartridge feed channel 11. Preferably, the stationary cartridge feed channel 12 is mounted at a 45° inclination with respect to the horizon in order to avoid extreme deflection or bending of the cartridge belt.

According to FIGS. 1–3, the surfaces generated by the cartridge axes 10 are essentially helicoidal surfaces. When determining the shape of these helicoidal surfaces, it must be taken into consideration that the centers of gravity of the cartridges 14 do not lie in the center point of the lines B–C and A–D and that the tensile force which transports the belt for the cartridges to the weapon preferably be exerted through the centers of gravity of the cartridges 14. In order to keep forces at a minimum, the centers of gravity of the cartridges 14 must lie accurately on a helix. This helix generated or defined by the centers of gravity of the cartridges 14, is located along the surface of an imaginary circular cylinder 20 while the cartridge axes 10 of the cartridges 14, form respective tangents to this cylinder, whereby the center of gravity of the cartridges 14 represent the contact points of these tangents on the lengthwise cylinder. Thus, it will be apparent that the lengthwise axis of the helix is defined by the lengthwise axis S of the imaginary circular cylinder 20. Lines B–C and A–D are inclined by 45° with respect to the cylinder or helix axis.

It will also be appreciated that the bottom or base 14*a* of the cartridges 14 are disposed within the pivotable rigid or non-flexible feed channel 11 such that the bottom or base of neighboring cartridges are spaced at a distance from one another which is substantially equal to the spacing or distance between the tips 14*b* of neighboring cartridges 14.

According to FIGS. 1–3, whenever the weapon barrel is in a non-elevated, i.e. in a horizontal position, the horizontally located elevation axis 16 lies considerably below the weapon barrel axis 40 whereby the pivotable cartridge feed channel 11 assumes a simpler shape as compared to having the elevation axis and weapon barrel axis lying within the same plane.

Figure 6:
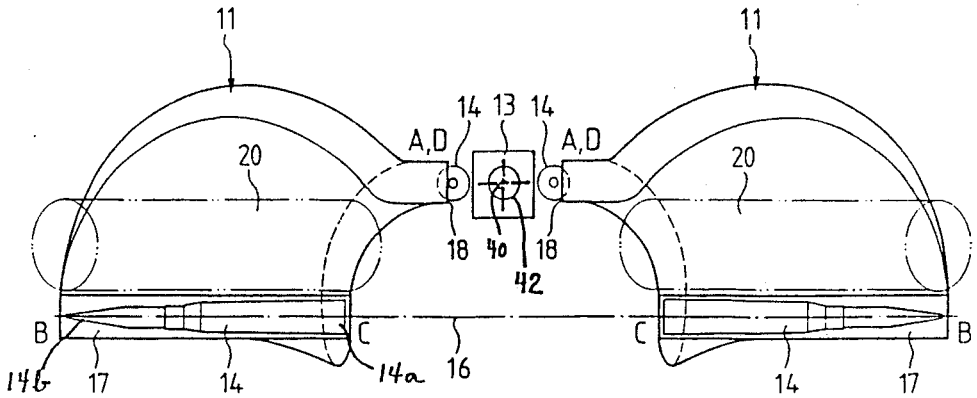
* and FIG. 6 shows a schematic view of a firing weapon comprising two rigid or non-flexible helical cartridge feed channels.

As shown in FIG. 6, two feed channels 11*a* and 11*b* arranged in mirror image relationship may be attached to the firing weapon 13 opposite each other. For safety reasons, tips of the cartridges 14 located within the elevation axis 16 are directed away from the firing weapon 13.

While there are shown and described present preferred embodiments of the invention, it is to be distinctly understood that the invention is not limited thereto, but may be otherwise variously embodied and practiced within the scope of the following claims.

What I claim is:

1. An apparatus for feeding cartridges from a stationary container to a firing weapon adjustable in elevation about an elevation axis, said apparatus comprising:

supply means for cartridges to be transported to a region at least in a neighborhood of the elevation axis of the firing weapon;

deflection means cooperating with the supply means for deflecting the cartridges according to a given elevation of the firing weapon and for infeeding the cartridges into the firing weapon;

said deflection means comprising a substantially helical non-flexible cartridge feed channel connected to the firing weapon;

said substantially helical non-flexible cartridges feed channel defining an infeed opening and an outfeed opening;

the cartridges being arranged substantially parallel to the elevation axis at said infeed opening of said substantially helical non-flexible cartridge feed channel;

said infeed opening of said substantially helical non-flexible cartridge feed channel being located at the region at least in the neighborhood of said elevation axis of the firing weapon and during adjustment of the elevation of the firing weapon remaining at the region at least in the neighborhood of the elevation axis;

said firing weapon containing a weapon barrel defining a weapon barrel axis;

the cartridge being arranged substantially parallel to said weapon barrel axis at said outfeed opening of said substantially helical non-flexible cartridge feed channel;

each cartridge of said cartridges possessing a center of gravity;

said cartridges being located within said substantially helical non-flexible cartridge feed channel such that said centers of gravity are positioned substantially along a helix;

said helix substantially along which there are positioned said centers of gravity of the cartridges within said substantially helical non-flexible feed channel defines a lengthwise helix axis;

said helix being located along the surface of an imaginary cylinder defining a lengthwise cylinder axis;

said lengthwise helix axis substantially coinciding with said lengthwise cylinder axis; and said lengthwise helix axis extending at an inclination angle of substantially 45° with respect to said elevation axis as well as with respect to said weapon barrel axis and which elevation axis and weapon barrel axis cross each other in space at substantially right angles.

2. An apparatus for feeding cartridges from a stationary container to a firing weapon adjustable in elevation about an elevation axis, said apparatus comprising:

supply means for cartridges to be transported to a region at least in a neighborhood of the elevation axis of the firing weapon;

deflection means cooperating with the supply means for deflecting the cartridges according to a given elevation of the firing weapon and for infeeding the cartridges into the firing weapon;

said deflection means comprising a substantially helical non-flexible cartridge feed channel connected to the firing weapon;

said substantially helical non-flexible cartridge feed channel defining an infeed opening and an outfeed opening;

the cartridges being arranged substantially parallel to the elevation axis at said infeed opening of said substantially helical non-flexible cartridge feed channel;

said infeed opening of said substantially helical non-flexible cartridge feed channel being located at the region at least in the neighborhood of said elevation axis of the firing weapon and during adjustment of the elevation of the firing weapon remaining at the region at least in the neighborhood of the elevation axis;

said firing weapon containing a weapon barrel defining a weapon barrel axis;

the cartridges being arranged substantially parallel to said weapon barrel axis at said outfeed opening of said substantially helical non-flexible cartridge feed channel;

each cartridge of said cartridges possessing a center of gravity;

said cartridges being located within said substantially helical non-flexible cartridge feed channel such that said centers of gravity are positioned substantially along a helix;

each cartridge of said cartridges defines a cartridge axis;

said cartridge axes of the cartridges located within said substantially helical cartridge feed channel defining an approximately helicoidal surface;

said helix substantially along which there are positioned said centers of gravity of the cartridges within said substantially helical non-flexible cartridge feed channel being located on a surface of an imaginary cylinder; and said cartridge axes being tangent to the surface of said imaginary cylinder at said centers of gravity of the cartridges.

3. The apparatus as defined in claim 2, wherein:

a predeterminate elevation of said firing weapon defining an elevation in which said weapon barrel of said firing weapon is substantially horizontally aligned; and said infeed opening of said substantially helical non-flexible cartridge feed channel being located at a lower level than said outfeed opening of said substantially helical non-flexible cartridge feed channel when said weapon barrel of said firing weapon is in substantially horizontally aligned elevation.

4. The apparatus as defined in claim 2, wherein:

said supply means comprises a stationary cartridge container.

5. The apparatus as defined in claim 2, wherein:

said supply means comprises a stationary cartridge feed channel.

6. The apparatus as defined in claim 2, wherein:

the cartridges are substantially coaxially arranged with respect to the elevation axis at said infeed opening of said substantially helical non-flexible cartridge feed channel.

7. The apparatus as defined in claim 2, wherein:

each cartridge has a tip and a base;

the tips as well as the bases of neighboring cartridges within the substantially non-flexible helical cartridge feed channel being respectively located at a predetermined distance from one another; and the tips of neighboring cartridges being located at least at approximately the same predetermined distance from one another as the bases of neighboring cartridges located within the substantially non-flexible helical cartridge feed channel.

8. The apparatus as defined in claim 2, wherein:

said infeed opening of said substantially helical non-flexible cartridge feed channel which is located at the region at least in the neighborhood of said elevation axis of the firing weapon during adjustment of the elevation of the firing weapon rotating about the elevation axis.

9. An apparatus for feeding cartridges from a stationary container to a firing weapon adjustable in elevation about an elevation axis, said apparatus comprising:

supply means for cartridges to be transported to a region at least in a neighborhood of the elevation axis of the firing weapon;

deflection means cooperating with the supply means for deflecting the cartridges according to a given elevation of the firing weapon and for infeeding the cartridges into the firing weapon;

said deflection means comprising a substantially helical non-flexible cartridge feed channel connected to the firing weapon;

said substantially helical non-flexible cartridge feed channel defining an infeed opening and an outfeed opening;

the cartridges being arranged substantially parallel to the elevation axis at said infeed opening of said substantially helical non-flexible cartridge feed channel;

said infeed opening of said substantially helical non-flexible cartridge feed channel being located at the region at least in the neighborhood of said elevation axis of the firing weapon and during adjustment of the elevation of the firing weapon remaining at the region at least in the neighborhood of the elevation axis;

said firing weapon containing a weapon barrel defining a weapon barrel axis;

the cartridges being arranged substantially parallel to said weapon barrel axis at said outfeed opening of said substantially helical non-flexible cartridge feed channel;

each cartridge of said cartridges possessing a center of gravity;

said cartridges being located within said substantially helical non-flexible cartridge feed channel such that said centers of gravity are positioned substantially along a helix; and said substantially helical non-flexible cartridge feed channel is wound about an imaginary cylinder having a cylinder axis inclined through an angle of approximately 45° in relation to said elevation axis and with respect to said weapon barrel axis.

10. An apparatus for feeding cartridges to an elevatable firing weapon, comprising:

deflection means for deflecting the cartridges according to a predetermined elevation of the elevatable firing weapon and for infeeding the cartridges into the firing weapon;

said deflection means comprising a non-flexible substantially helical cartridge feed channel mounted on the firing weapon;

said non-flexible substantially helical cartridge feed channel defining an infeed opening and an outfeed opening;

said firing weapon defining an elevation axis;

the cartridges being substantially parallely arranged with respect to said elevation axis at said infeed opening of said non-flexible substantially helical cartridge feed channel;

said infeed opening of said non-flexible substantially helical cartridge feed channel being located adjacent to said elevation axis of the firing weapon and during adjustment of the elevation of the firing weapon remaining adjacent the elevation axis;

said firing weapon containing a weapon barrel defining a weapon barrel axis;

said non-flexible substantially helical cartridge feed channel being wound about an imaginary cylinder having a cylinder axis inclined through a substantially identical angle with respect to the elevation axis and the weapon barrel axis;

the cartridges being arranged substantially parallel to said weapon barrel axis at said outfeed opening of said non-flexible substantially helical cartridge feed channel;

each cartridge of the cartridges possessing a center of gravity; and the cartridges being located within said non-flexible substantially helical cartridge feed channel such that said centers of gravity are positioned substantially along a helix.

11. An apparatus for feeding cartridges to an elevatable firing weapon, comprising:

deflection means for deflecting the cartridges according to a predetermined elevation of the elevatable firing weapon and for infeeding the cartridges into the firing weapon;

said deflection means comprising a rigid substantially helical cartridge feed channel mounted on the firing weapon;

said rigid substantially helical cartridge feed channel defining an infeed opening and an outfeed opening;

said firing weapon defining an elevation axis and a region at least in the neighborhood of said elevation axis;

said firing weapon containing a weapon barrel defining a weapon barrel axis;

said rigid substantially helical cartridge feed channel from the infeed opening to the outfeed opening of said cartridges is wound about an imaginary cylinder having a cylinder axis inclined at an angle which is substantially the same angle in relation to said elevation axis and in relation to said weapon barrel axis;

said infeed opening of said rigid substantially helical cartridge feed channel being located at the region at least in the neighborhood of said elevation axis of the firing weapon and during adjustment of the elevation of the firing weapon remaining at the region at least in the neighborhood of the elevation axis;

the cartridges being arranged substantially parallel to said weapon barrel axis at said outfeed opening of said rigid substantially helical cartridge feed channel;

each cartridge of the cartridges possessing a center of gravity; and the cartridges being located within said rigid substantially helical cartridge feed channel such that said centers of gravity are positioned substantially along a helix.

12. The apparatus as defined in claim 11, wherein:

said angle at which said cylinder axis is inclined in relation to said elevation axis and in relation to said weapon barrel axis, amounts to essentially 45°.

13. The apparatus as defined in claim 11, wherein:

each cartridge has a tip portion and a base portion;

the tip portions as well as the base portions of neighboring cartridges within the rigid substantially helical cartridge feed channel being respectively located at a predetermined spacing from one another; and the predetermined spacing between the tip portions of neighboring cartridges within the rigid substantially helical cartridge feed channel being at least approximately equal to the predetermined spacing of the base portions of the neighboring cartridges within the rigid substantially helical cartridge feed channel.

* * * * *